US010506676B2

(12) United States Patent
Lin et al.

(10) Patent No.: US 10,506,676 B2
(45) Date of Patent: Dec. 10, 2019

(54) LED DRIVER AND DRIVING METHOD THEREOF

(71) Applicant: LEDVANCE GmbH, Garching bei Munchen (DE)

(72) Inventors: Shengdie Lin, Guangdong (CN); Yang Liu, Guangdong (CN)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 16/170,643

(22) Filed: Oct. 25, 2018

(65) Prior Publication Data

US 2019/0124737 A1 Apr. 25, 2019

(30) Foreign Application Priority Data

Oct. 25, 2017 (CN) ..... 2017 1 10077569

(51) Int. Cl.
*H05B 33/08* (2006.01)

(52) U.S. Cl.
CPC ..... *H05B 33/0815* (2013.01)

(58) Field of Classification Search
CPC .. H05B 336/00; H05B 336/02; H05B 336/08; H05B 336/0803; H05B 336/0806; H05B 336/0812; H05B 336/0815; H05B 37/02; H05B 37/0209; H05B 37/036
See application file for complete search history.

(56) References Cited

U.S. PATENT DOCUMENTS

| | | | | |
|---|---|---|---|---|
| 8,183,795 | B2 * | 5/2012 | Huang | H05B 33/0818 315/291 |
| 9,398,655 | B2 * | 7/2016 | Rupp | H05B 33/083 |
| 2006/0284569 | A1 * | 12/2006 | Wey | H05B 33/0809 315/282 |
| 2007/0139317 | A1 * | 6/2007 | Martel | H05B 33/0827 345/82 |
| 2011/0227489 | A1 * | 9/2011 | Huynh | H05B 33/083 315/185 R |
| 2011/0266970 | A1 * | 11/2011 | Cohen | H05B 33/0815 315/294 |
| 2013/0069550 | A1 * | 3/2013 | Kamata | H05B 33/0818 315/201 |
| 2013/0187561 | A1 * | 7/2013 | Franck | H05B 33/0815 315/201 |
| 2017/0280523 | A1 * | 9/2017 | Kathiresan | H05B 33/0815 |
| 2017/0311396 | A1 * | 10/2017 | Sadwick | F21V 25/00 |

* cited by examiner

*Primary Examiner* — Jason Crawford
(74) *Attorney, Agent, or Firm* — Hayes Soloway PC

(57) ABSTRACT

An LED driver and a driving method thereof include at least two sub-LED drivers connected in series between two terminals of an AC power source. The at least two sub-LED drivers have a common configuration. Each sub-LED driver includes a switch circuit having a first reference ground, an inductor having a first terminal connected to the first reference ground and a first capacitor. The first capacitor has a first terminal connected to a second terminal of the inductor and a second terminal connected to a second reference ground. A load with at least one LED to be driven is connected between the first terminal and the second terminal of the first capacitor. An inductance value of the inductor is designed such that each sub-driver operates in an open loop mode. The LED driver and the driving method thereof can achieve an output current balance between the respective sub-LED drivers.

11 Claims, 5 Drawing Sheets

LED DRIVER AND DRIVING METHOD THEREOF

CROSS-REFERENCE

This patent application claims priority from Chinese Patent Application No. 2017110077569 filed Oct. 25, 2017, which is herein incorporated by reference in its entirety.

TECHNICAL FIELD

The present invention relates to the field of illumination technology, and in particular to an LED driver and a driving method thereof.

BACKGROUND

With the development of LED illumination technology, multiple LED drivers working in tandem mode have been widely used. However, when a conventional LED driver with a constant current output is used in multiple LED drivers working in tandem mode, there exists the problem of how to maintain an input voltage balance among the multiple LED drivers working in tandem mode to maintain the multiple LED drivers output current to be the same.

SUMMARY

In order to solve the above problem, the present invention provides an LED driver and a driving method thereof, the LED driver comprising at least two sub-LED drivers connected in series between two terminals of an AC power source, wherein the respective sub-LED drivers have a same configuration and operate in an open loop mode under the control of values of inductors included in the respective sub-LED drivers so that the output current balance among the respective sub-LED drivers connected in series can be achieved.

For this purpose, the present invention provides an LED driver comprising at least two sub-LED drivers connected in series between two terminals of an AC power source, wherein the at least two sub-LED drivers have a same configuration, each sub-LED driver comprising: a switch circuit having a first reference ground interface connected to a first reference ground, an inductor having a first terminal connected to the first reference ground; and a first capacitor having a first terminal connected to a second terminal of the inductor and a second terminal connected to a second reference ground, and a load comprising at least one LED to be driven connected between the first terminal and the second terminal of the first capacitor; wherein an inductance value of the inductor in each sub-LED driver is designed such that the sub-LED driver operates in an open loop mode.

Optionally, the switch circuit includes an LED power switch chip based on a power MOSFET.

Optionally, the inductance value of the inductor is determined by a desired voltage and current of the load, a longest ON-Time of the switch circuit, and a voltage applied to the sub-LED driver.

Optionally, the longest ON-Time is 5 to 35 μs.

Optionally, the LED power switch chip comprises a buck-type active power factor correction LED power switch chip having a constant current output loop compensation interface, a first reference ground interface, a chip power supply interface, an inductor current degauss detection and output overvoltage protection interface, an internal power MOSFET drain input interface and a current sampling input interface, wherein the internal power MOSFET drain input interface is connected to the AC power source; the current sampling input interface is connected to the first reference ground via a first resistor, the chip power supply interface and the constant current output loop compensation interface are connected to the first reference ground via a second capacitor and a third capacitor, respectively, and the inductor current degauss detection and output overvoltage protection interface is connected to the second terminal of the inductor via a second resistor, and is connected to the first terminal of the inductor via a third resistor.

Optionally, each sub-LED driver further comprises a bridge rectifier connected between two terminals of a power source for the sub-LED driver.

Optionally, the bridge rectifier of each sub-LED driver is connected to the two terminals of the power source for the sub-LED driver by an adjustable resistor connected in parallel with the bridge rectifier.

Optionally, the LED driver further comprises an inductance ballast connected to an input terminal of the AC power source.

Optionally, the LED driver comprises two sub-LED drivers connected in series, and the inductance value of the inductor of each sub-LED driver is 0.5 mH to 15 mH.

In addition, the present invention further provides a driving method of the LED driver, the LED driver comprising at least two sub-LED drivers connected in series between two terminals of an AC power source, wherein the at least two sub-LED drivers have a same configuration, each sub-LED driver comprising: a switch circuit having a first reference ground interface connected to a first reference ground, an inductor having a first terminal connected to the first reference ground; and a first capacitor having a first terminal connected to a second terminal of the inductor and a second terminal connected to a second reference ground, and a load comprising at least one LED to be driven connected between the first terminal and the second terminal of the first capacitor; the driving method comprising: adjusting an inductance value of the inductor in each sub-LED driver such that the sub-LED driver operates in an open loop mode.

Optionally, the LED driver includes n sub-LED drivers, and a voltage applied to each LED sub-driver is 1/n of an input voltage of the AC power source.

In the LED driver provided by the present invention, the plurality of sub-LED drivers connected in series have a same configuration, and each sub-LED driver comprises a switch circuit, an inductor and a capacitor, wherein an LED load to be driven is to be connected between two terminals of the capacitor, the sub-LED driver with such a configuration constitutes a BUCK circuit, and by adjusting the inductance value of each inductor, each of the sub-LED drivers will operate in an open loop mode. Thus, in a case where the LED loads to be driven by the respective sub-LED drivers are the same, the input impedances of the respective sub-LED drivers are the same. Therefore, the output currents of the LED loads driven by the respective sub-LED drivers are the same, so that the output current balance among the sub-LED drivers is achieved

BRIEF DESCRIPTION OF THE DRAWINGS

An LED driver and a driving method thereof provided by the present invention will be described in detail below with reference to the accompanying drawings.

DETAILED DESCRIPTION

To allow a person skilled in the art better understanding the technical solutions of the present invention, the LED driver and the driving method thereof provided in the invention will be described in detail in conjunction with the accompanying drawings.

First Embodiment

Figure 1:
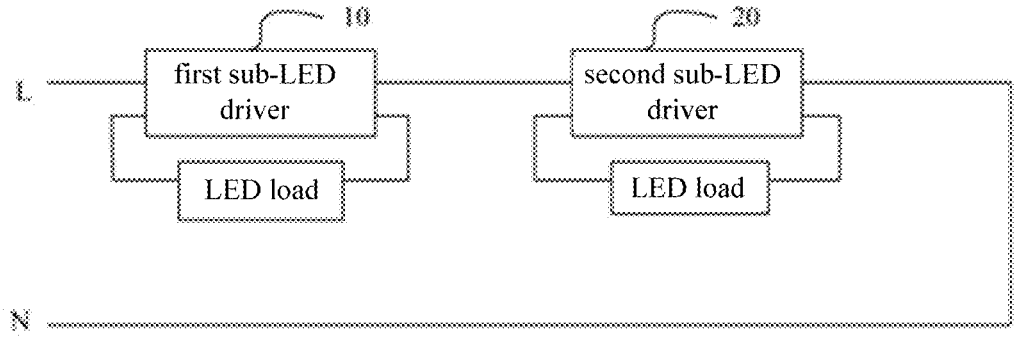
FIG. 1 shows a schematic view of a structure of an LED driver according to an embodiment of the present invention.

FIG. 1 shows a schematic view of a structure of an LED driver according to a first embodiment of the present invention. As shown in FIG. 1, the LED driver includes a first sub-driver 10 and a second sub-driver 20 connected in series between two terminals of an AC power source, each sub-LED driver is configured to drive an LED load including at least one LED. The first sub-driver 10 and the second sub-driver 20 have a same configuration.

Figure 2:
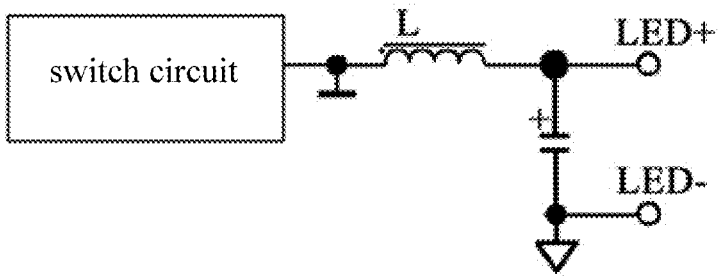
FIG. 2 shows a schematic view of a structure of a sub-LED driver included in the LED driver according to an embodiment of the present invention.

FIG. 2 shows a specific example of the first sub-LED driver or the second sub-LED driver included in the LED driver as shown in FIG. 1. As shown in FIG. 2, each sub-LED driver of the LED driver of the present invention includes: a switch circuit having a first reference ground interface connected to a first reference ground, an inductor L having a first terminal connected to the first reference ground; and a first capacitor having a first terminal connected to the second terminal of the inductor L and a second terminal connected to a second reference ground, a load including at least one LED to be driven connected between the first terminal and the second terminal of the first capacitor; wherein a value of the inductor L included in each of the sub-drivers is designed such that each of the sub-drivers operates in an open loop mode.

The first reference ground may be a reference ground for a chip where the switch circuit is located, and the second reference ground may be a reference ground for other components other than the chip where the switch circuit is located.

As described above, each of the sub-LED drivers included in the LED driver of the present invention includes a switch circuit, an inductor, and a capacitor, and the LED load to be driven is connected between the two terminals of the capacitor. The sub-LED driver with such a configuration is equivalent to a complicated BUCK circuit, wherein the inductor is designed to have a value which enables the sub-LED driver to operate in an open loop mode.

The switch circuit of the present invention may be an LED power switch chip based on a power MOSFET, and has a longest ON-Time Ton_max based on a power MOSFET. For this kind of switch circuit, the value of the inductor is determined by the desired voltage and current of the load, the longest ON-Time of the switch circuit, and the voltage applied to the sub-LED driver, wherein the longest ON-Time Ton_max may be selected to be 5 to 35 μs. However, the present invention is not limited thereto, and any switch circuit which can be used together with an inductor and a capacitor to enable the sub-LED driver to operate in an open loop mode under the control of the value of an inductor falls within the protection scope of the present invention.

The LED driver of the present invention includes a plurality of sub-LED drivers connected in series between two terminals of the AC power source. These sub-LED drivers operate in tandem mode and the input voltage of the AC power source will be re-distributed on the plurality of sub-LED drivers. Therefore, the input voltage for each sub-LED driver of the plurality of sub-LED drivers will be less than the input voltage for a single sub-LED driver directly connected between the two terminals of the AC power supply, and thus each sub-LED driver of the plurality of sub-LED drivers cannot provide a drive voltage enough for the LED load to be driven. Therefore, the ON-Time Ton of the sub-LED driver will continue to increase until the longest ON-Time Ton_max of the switch circuit is reached. When the ON-Time Ton of the sub-LED driver reaches the longest ON-Time Ton_max, since the value of the inductor L is designed such that each of the sub-drivers operates in an open loop mode, the output current of the sub-LED driver will only be determined by the equivalent impedance of the LED load. In order to obtain a current balance between the respective LED loads, the LED loads driven by the respective sub-LED drivers are generally the same. Thus, the output current of the respective sub-LED drivers will be substantially the same so that an output current balance among the respective sub-LED drivers can be achieved. The larger the LED load is, the smaller the inductance value of the inductor L is, and the LED load and the inductance value have an approximate inversely proportional relationship therebetween. When the LED driver comprises two sub-LED drivers in tandem mode, the value of the inductor of each LED sub-driver may be 0.5 mH to 15 mH.

Figure 3:
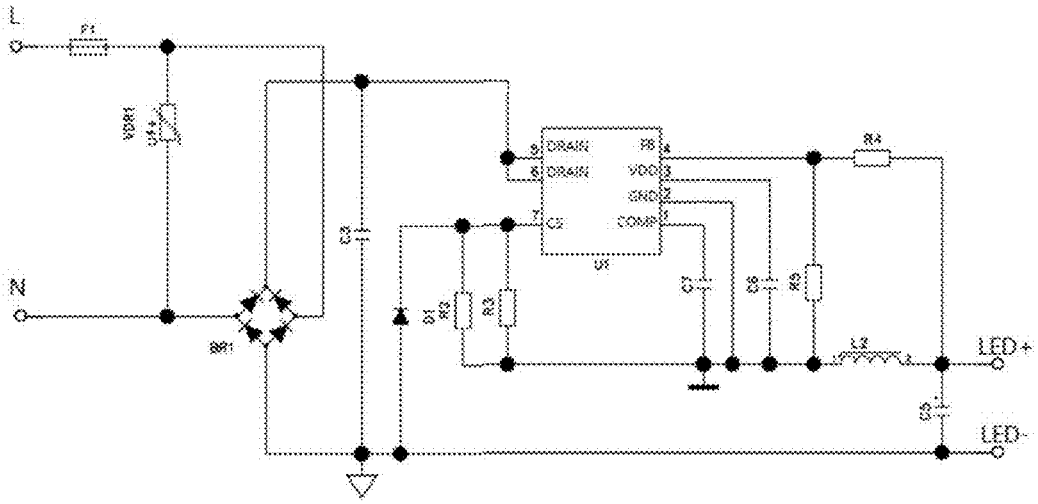
FIG. 3 shows a schematic view of a structure of a sub-LED driver according to an embodiment of the present invention.

FIG. 3 shows a specific example of the sub-LED driver included in the LED driver of the present invention. As shown in FIG. 3, the LED power switch as a sub-LED driver may comprise a buck-type active power factor correction LED power switch chip U1 (e.g. KP106X series chip of non-isolated, buck-type active power factor correction LED power switch) with a constant current output loop compensation interface COMP, a first reference ground interface GND, a chip power supply interface VDD, an inductor current degauss detection and output overvoltage protection interface FB, an internal power MOSFET drain input interface Drain and a current sampling input interface CS, wherein the internal power MOSFET drain input interface Drain is connected to the AC power source; the current sampling input interface CS is connected to the first reference ground of the switch chip U1 via a resistor R2 or R3, the chip power supply interface VDD and the constant current output loop compensation interface COMP are connected to the first reference ground via a capacitor C6 and a capacitor C7, respectively, and the inductor current degauss detection and output overvoltage protection interface FB is connected to the second terminal of the inductor via a second resistor R4, and is connected to the first terminal of the inductor via a resistor R5.

As shown in FIG. 3, preferably, a capacitor C3 may be connected between the internal power MOSFET drain input interface Drain and a ground line to play a role of filtering, its value should not be too large and may be between 100N-150N, and the size of the capacitor C3 will affect the power factor and harmonic distortion. The larger the capacitance value is, the smaller the power factor is, and the greater the harmonic distortion is.

Preferably, a diode D1 is connected between the current sampling input interface CS and the ground line of the sub-LED driver, and functions as a freewheeling diode for the entire sub-LED driver as a buck-type conversion circuit (Buck circuit). When the sub-LED driver is turned off, the diode D1 functions as a fast-recovery rectifier diode and plays a role of free-wheeling. Preferably, the reverse recovery time of the diode D1 is relatively small, for example, less than 75 ns.

The LED driver shown in FIG. 1 includes only two sub-LED drivers, but the present invention is not limited thereto. The number of the sub-LED drivers included in the LED driver of the present invention may be two or more.

As shown in FIG. 1, for example, the LED driver of the present invention includes two sub-LED drivers operating in tandem mode and connected in series between two terminals of the AC power source of 220V-240V. The LED loads driven by the respective sub-LED drivers are the same and have the same parameter. As such, the input voltage of each sub-LED driver is reduced to approximately 110V-120V, and thus each sub-LED driver is unable to provide enough output for the LED load. Therefore, the ON-Time Ton of each sub-LED driver will increase until the longest ON-Time Ton_max of the switch circuit is reached (for example, the longest ON-Time Ton_max may be 5 to 35 μs, which depends on the switch circuit being used). When the ON-Time Ton reaches the longest ON-Time Ton_max, since the value of the inductor L is designed such that each of the sub-drivers operates in an open loop mode, the output current of each sub-LED driver is determined by the equivalent impedance of the LED load. Since the LED loads driven by the two sub-LED drivers are the same, the output current of the two sub-LED drivers will be the same. As a result, the output current balance between the two sub-LED drivers is achieved.

As shown in FIG. 1, since the two sub-LED drivers have a same configuration and the LED loads driven by the two sub-LED drivers are also the same, in order to achieve the output current balance between the two sub-LED drivers, the inductance values of the inductors included in the respective sub-LED drivers should also be the same. The inductance value of the inductor ensures that the sub-LED driver operates in an open loop mode. In practice, adjusting the inductance value of the inductor causes the sub-LED driver to enter the open loop mode at a rated voltage input Vin/N (Vin is an input voltage of the AC power source, and N is the number of the sub-LED drivers). As such, for the LED output current, a turning point from the constant output in the original closed-loop state to a significantly smaller output is seen.

Figure 4:
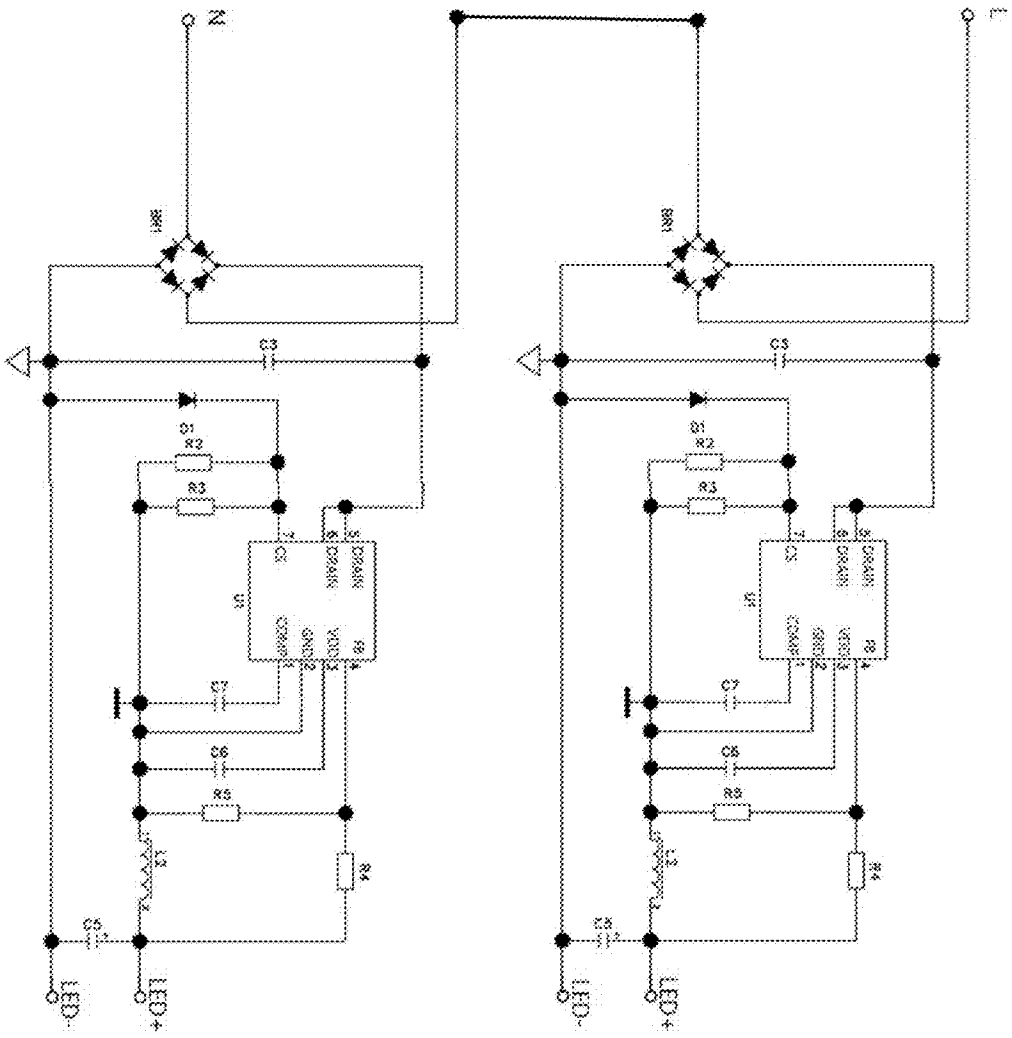
FIG. 4 shows a schematic view of structure of an LED driver according to an embodiment of the present invention.
Figure 5:
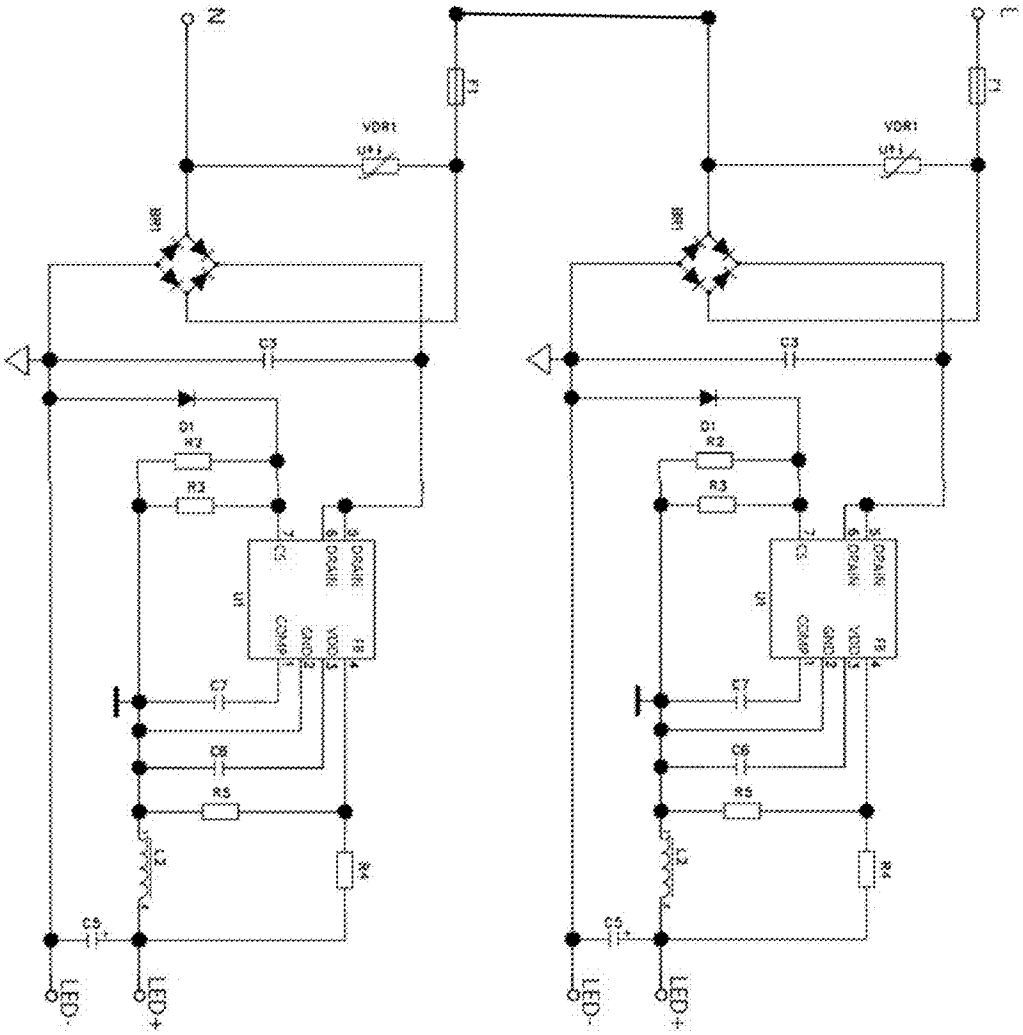
FIG. 5 shows a schematic view of a structure of an LED driver according to an embodiment of the present invention.

FIG. 4 and FIG. 5 show schematic views of structures of the LED drivers of the present invention based on the sub-LED driver shown in FIG. 3, respectively.

The LED drivers in FIG. 4 and FIG. 5 each include two tandem sub-LED drivers connected in series between two terminals of the AC power source. An input terminal of each sub-LED driver is connected to an output terminal of a bridge rectifier BR1. In FIG. 5, an adjustable resistor VDR1 is connected in parallel between an input terminal and the output terminal of the bridge rectifier BR1, and a fuse F1 is provided between an input terminal of the adjustable resistor VDR1 and an output terminal L of the AC power source, in order to play a role of current overload protection.

Figure 6:
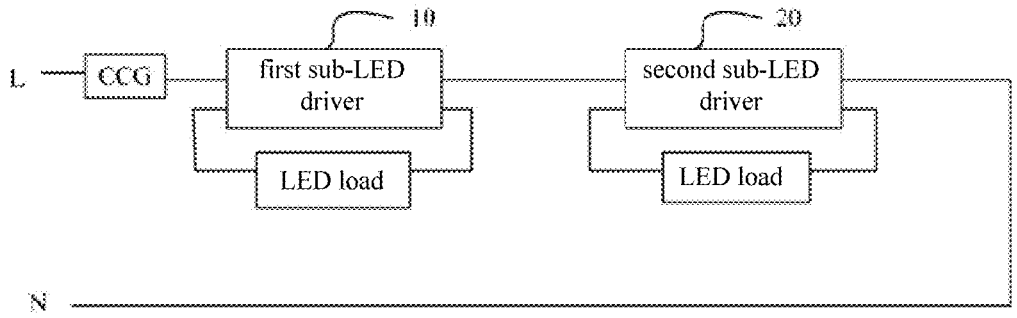
FIG. 6 shows a schematic view of a structure of an LED driver according to an embodiment of the present invention.
Figure 7:
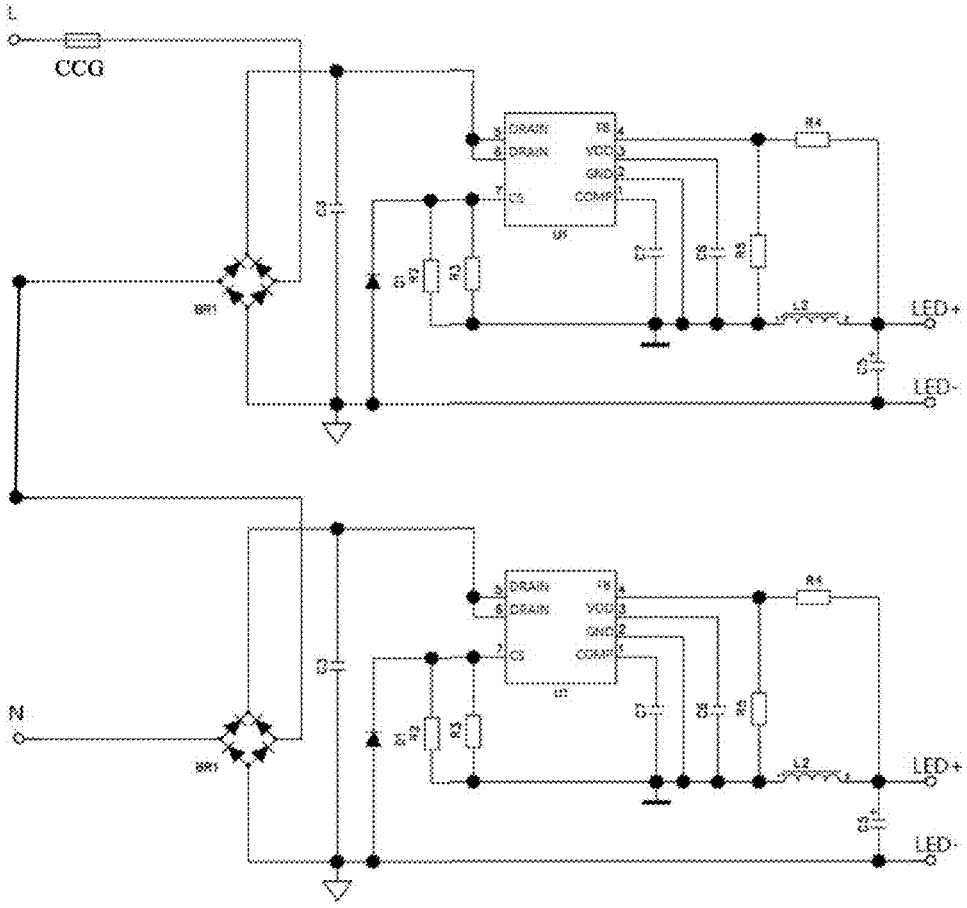
FIG. 7 shows a schematic view of a structure of an LED driver according to an embodiment of the present invention.

FIG. 6 shows a schematic view of a structure of an LED driver according to an embodiment of the present invention. Different from the structure shown in FIG. 1, an inductance ballast (CCG for short) is disposed between the first sub-LED driver 10 and the AC power input terminal L of the LED driver of the present embodiment. Compatible with conventional tubes with the inductive ballast CCG existing in the market, the LED driver in this embodiment can be used directly without changing the existing lamps and circuits. FIG. 7 shows a schematic view of a structure of an LED driver including an inductance ballast CCG based on the sub-LED driver shown in FIG. 3.

Figure 8:
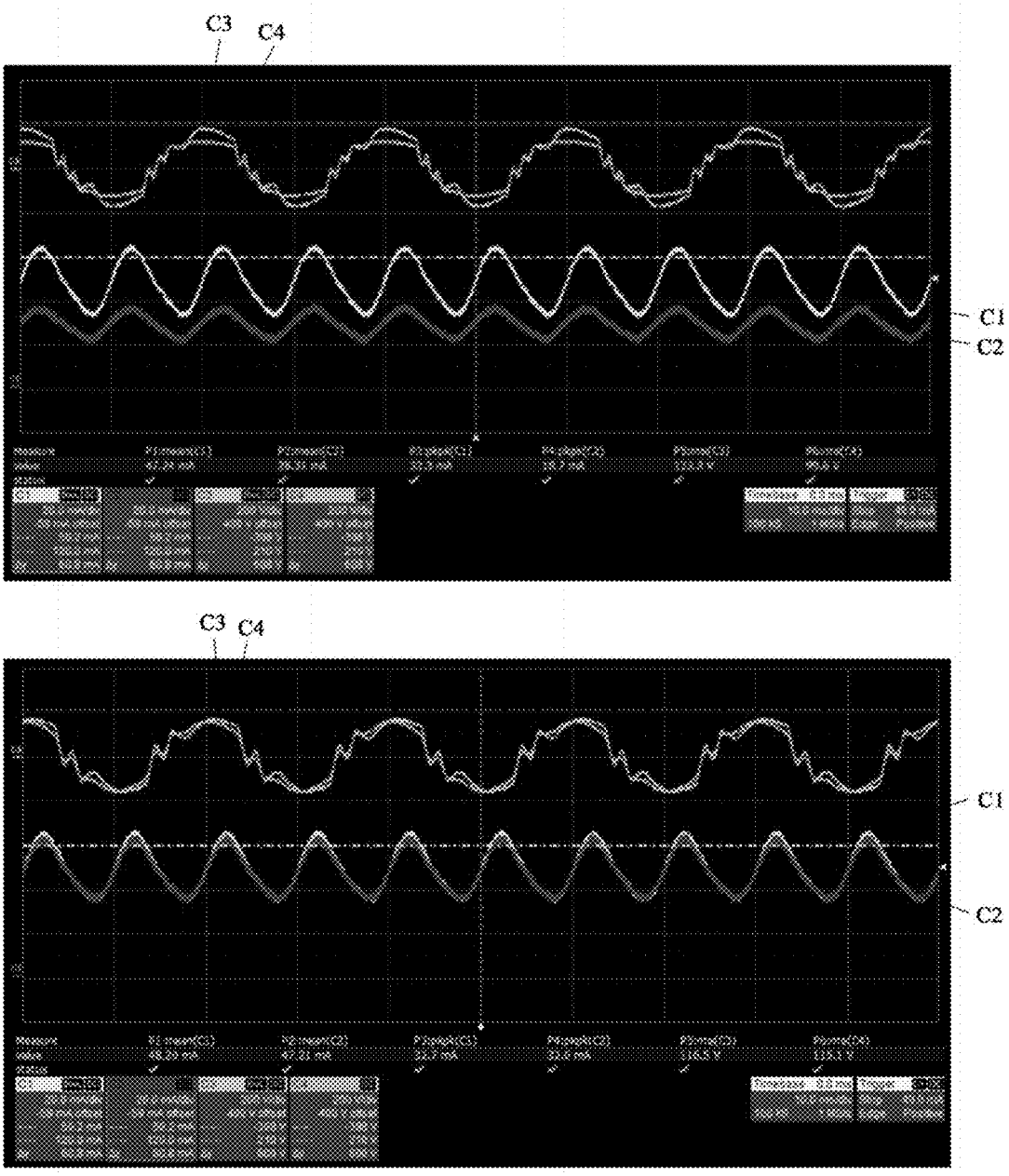
FIG. 8 illustrates waveforms of the respective output signals of the LED driver according to the present invention.

FIG. 8 illustrates waveforms of the output signals of the LED driver in the prior art (top) and according to the invention (bottom). FIG. 8 shows comparison between waveforms of the output signals of the LED driver in the prior art before improvement and the LED driver according to the present invention after improvement. In the LED driver in the prior art before improvement, two sub-LED drivers operate in tandem mode, wherein one of the sub-LED drivers operates in the open loop mode, and the other sub-LED driver operates in a closed loop mode, and in this case, the input voltages of the two sub-LED drivers are different and greatly different from each other, and the output currents of the two sub-LED drivers are also different and greatly different from each other, so the balance between the two sub-LED drivers cannot be achieved.

Specifically, Vin_LED1=123.3V (C1), I_LED1=47.24 mA (C3);

Vin_LED2=99.6V (C2), I_LED2=28.31 mA (C4).

The LED driver in the prior art is improved with the concept of the present invention. The inductance value of the inductor included in each sub-LED driver is adjusted so that both of the two sub-LED drivers included in the LED driver operate in the open loop mode, and as such, the input voltages of the two sub-LED drivers are substantially the same and the output currents are also substantially the same so that the balance between the two sub-LED drivers can be achieved.

Specifically, Vin_LED1=116.5V (C1), I_LED1=48.2 mA (C3);

Vin_LED2=115.1V (C2), I_LED2=47.2 mA (C4).

As can be seen from the above embodiments, the LED driver according to the present invention comprises a plurality of sub-LED drivers connected in series between two terminals of the AC power source, the plurality of sub-LED drivers have the same configuration, each sub-LED driver comprises a switch circuit, an inductor and a capacitor, and an LED load to be driven will be connected between two terminals of the capacitor. The sub-LED driver with such a configuration constitutes a similar BUCK circuit, and by adjusting the inductance value of each inductor, the sub-LED driver will operate in the open loop mode, and thus, in a case where the LED loads to be driven by the respective sub-drivers are the same, the input impedances of the respective sub-LED drivers are the same. Therefore, the output current of the loads driven by the respective sub-LED drivers are the same, so the output current balance among the sub-LED drivers is achieved.

It should be understood that the above embodiments are merely exemplary embodiments for the purpose of illustrating the principle of the disclosure, and the invention is not limited thereto. Various modifications and improvements can be made by a person skilled in the art without departing from the spirit and essence of the disclosure. Accordingly, all of the modifications and improvements also fall into the protection scope of the disclosure.

What is claimed is:

1. An LED driver, comprising at least two sub-LED drivers connected in series between two terminals of an AC power source, wherein the at least two sub-LED drivers have a same configuration, each sub-LED driver comprising:

a switch circuit, having a first reference ground interface connected to a first reference ground, an inductor, having a first terminal connected to the first reference ground; and a first capacitor, having a first terminal connected to a second terminal of the inductor and a second terminal connected to a second reference ground, and a load comprising at least one LED to be driven connected between the first terminal and the second terminal of the first capacitor;

wherein an inductance value of the inductor in each sub-LED driver causes the sub-LED driver to operate in an open loop mode.

2. The LED driver according to claim 1, wherein the switch circuit further comprises an LED power switch chip having a power MOSFET.

3. The LED driver according to claim 2, wherein the inductance value of the inductor is determined by a desired voltage and current of the load, a longest ON-Time of the switch circuit, and a voltage applied to the sub-LED driver.

4. The LED driver according to claim 3, wherein the longest ON-Time is 5 to 35 μs.

5. The LED driver according to claim 2, wherein the LED power switch chip comprises a buck-type active power factor correction LED power switch chip having a constant current output loop compensation interface, a first reference ground interface, a chip power supply interface, an inductor current degauss detection and output overvoltage protection interface, an internal power MOSFET drain input interface and a current sampling input interface, wherein, the internal power MOSFET drain input interface is connected to the AC power source;

the current sampling input interface is connected to the first reference ground via a first resistor, the chip power supply interface and the constant current output loop compensation interface are connected to the first reference ground via a second capacitor and a third capacitor, respectively, and the inductor current degauss detection and output overvoltage protection interface is connected to the second terminal of the inductor via a second resistor, and is connected to the first terminal of the inductor via a third resistor.

6. The LED driver according to claim 5, wherein each sub-LED driver further comprises a bridge rectifier connected between two terminals of a power supply for the sub-LED driver.

7. The LED driver according to claim 6, wherein the bridge rectifier of each sub-LED driver is connected to the two terminals of the power source for the sub-LED driver by an adjustable resistor connected in parallel with the bridge rectifier.

8. The LED driver according to claim 5, further comprising an inductance ballast connected to an input terminal of the AC power source.

9. The LED driver according to claim 1, comprising two sub-LED drivers connected in series, and the inductance value of the inductor of each sub-LED driver is 0.5 mH to 15 mH.

10. A driving method of an LED driver, the LED driver comprising at least two sub-LED drivers connected in series between two terminals of an AC power source, wherein the at least two sub-LED drivers have a same configuration, each sub-LED driver comprising:

a switch circuit, having a first reference ground interface connected to a first reference ground, an inductor, having a first terminal connected to the first reference ground; and a first capacitor, having a first terminal connected to a second terminal of the inductor and a second terminal connected to a second reference ground, and a load comprising at least one LED to be driven connected between the first terminal and the second terminal of the first capacitor;

the driving method comprising:

adjusting an inductance value of the inductor in each sub-LED driver to operate the sub-LED driver in an open loop mode.

11. The driving method of the LED driver according to claim 10, wherein the LED driver includes n sub-LED drivers, and a voltage applied to each LED sub-driver is 1/n of an input voltage of the AC power source.

* * * * *